US005509537A

United States Patent [19]

Crismon et al.

[11] Patent Number: 5,509,537

[45] Date of Patent: Apr. 23, 1996

[54] SORTING MACHINE EJECTION SYSTEM

[75] Inventors: James E. Crismon; Jerry W. Brum, both of Modesto, Calif.

[73] Assignee: ESM International Inc., Houston, Tex.

[21] Appl. No.: 249,863

[22] Filed: May 26, 1994

[51] Int. Cl.[6] ..... B07C 5/00

[52] U.S. Cl. ..... 209/577; 209/580; 209/638; 209/657; 209/908; 198/367; 198/370.07

[58] Field of Search ..... 209/657, 656, 209/638, 908, 576, 577, 580, 934, 939; 198/367, 372

[56] References Cited

U.S. PATENT DOCUMENTS

| | | | |
|---|---|---|---|
| 3,980,181 | 9/1976 | Hoover et al. | 209/657 X |
| 4,168,005 | 9/1979 | Sandbank . | |
| 4,281,764 | 8/1981 | Fowler, Jr. | 209/657 X |
| 4,324,336 | 4/1982 | Sandbank | 209/657 X |
| 4,775,051 | 10/1988 | van der Schoot . | |
| 5,092,470 | 3/1992 | Häkansson . | |
| 5,278,768 | 1/1994 | Brum | 364/478 |
| 5,279,426 | 1/1994 | Crismon et al. . | |

FOREIGN PATENT DOCUMENTS 0241980 11/1985 Japan .

OTHER PUBLICATIONS

ESM International, Inc., "Colorwatch Technology That's Worth The Difference", 1990.

ESM "Agrisort–22", 1983.

*Primary Examiner*—David H. Bollinger

*Attorney, Agent, or Firm*—Vaden, Eickenroht, Thompson & Feather

[57] ABSTRACT

A sorting machine for separating substandard items from a continuous stream of products is disclosed wherein the ejector that removes the detected substandard items includes an ejector finger and an actuator. The ejector finger includes a flexible elongate base member fixedly attached with respect to the product stream and a contactor normally withdrawn from the product stream when standard products are in the stream and for entering the product stream to eject a detected substandard item. The actuator flexes the flexible elongate base member to move the ejector contactor so that it enters the product stream for ejecting each detected substandard item. The flexible elongate base member make the ejector more resistant to wear from environmental conditions. A flexible sorting machine ejector mounting mechanism is also disclosed which removes costly mounting mechanisms.

12 Claims, 4 Drawing Sheets

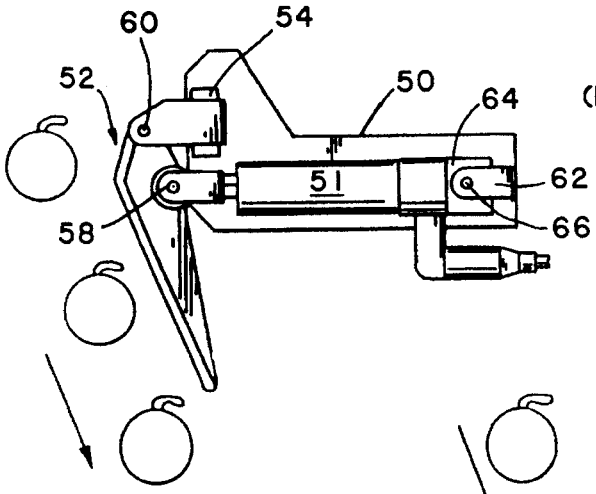
FIG. 3a
(PRIOR ART)
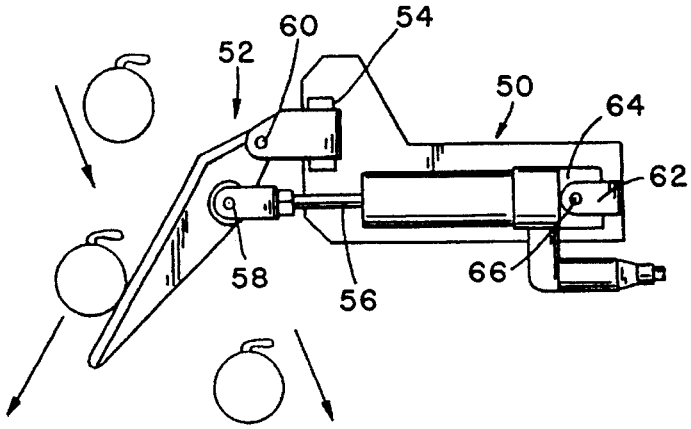
FIG. 3b
(PRIOR ART)
FIG. 4a
(PRIOR ART)
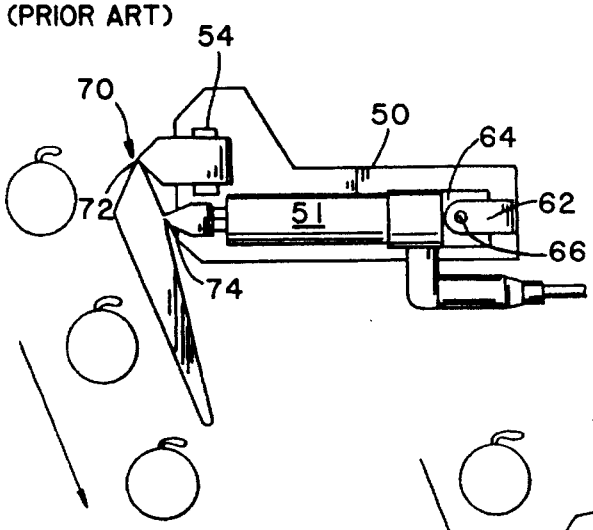
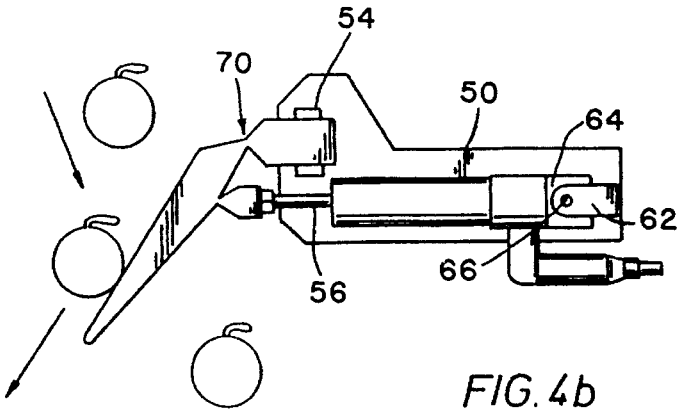
FIG. 4b
(PRIOR ART)

SORTING MACHINE EJECTION SYSTEM

BACKGROUND OF THE INVENTION

1. Field of the Invention

This invention generally pertains to a machine for mechanically ejecting selected items from a stream of products. More particularly this invention pertains to sorting machines that separate substandard items from standard items, the items passing through the machine in large volumes at high rates of speed.

2. Description of the Prior Art

A typical machine of the type envisioned for application of the present invention is a high speed sorting machine typically used for sorting fungible products in the food industry or otherwise. For example, individual tomatoes are caused to flow in front of an optical detector in such a machine to separate "substandard" items from standard product. The term "substandard" can apply to a tomato having undesirable characteristics or to unwanted items such as dirt clots, stems, and leaves. For instance, green tomatoes can be removed from a batch of tomatoes that are primarily red in color, or vice versa. The term may apply to product colors or different lengths or other qualities that are perfectly acceptable in the abstract, but are not within the standard limits of quality established for acceptable standard products for particular sorting.

The commonly employed sorting mechanism used in today's sorting machines is the optical sensor. Sensors include one or more photodetectors, such as photo diodes that are sensitive not only to black, white and shades of gray differences, but also to subtle variation in color hues. Also, many such sensors, including the entire sensor combination of parts, also are capable of discriminating against different sizes of products. All of the machines of the general class fitting the above description have in common a protective, light emitting window for the sensor or sensors to protect the sensors from contamination. In some cases, the window may protect only one sensor element, but in many cases, it is common that the housing enclose a plurality of sensors that are spaced about an opening through which the stream of product to be sorted is directed.

In order to pass the product in front of the window, many such systems utilize a dual conveyor belt system. Product enters the system on an incoming belt with the end of the belt positioned above the window such that when the product drops off the end it falls in front of the window on to a lower conveyor belt located beneath the window. The sensor determines whether the product in front of the window is substandard or standard.

Such machines also include an ejector located downstream from each sensor that is actuated by an electrical signal originating from sensor detection. When a substandard product is detected, an electrical actuating signal is produced and the ejector is actuated just as the substandard product and the ejector are in alignment. Therefore, there is a delay between detection and ejection, but it is ever so slight because the further the ejector is from the detector, the more substandard product can escape by being diverted or hit by other product in the product stream. Thus, the ejector is normally located as close as possible to the sensor or sensors, ideally being just downstream therefrom and closely adjacent thereto.

The ejector mechanism can be a compressed air ejector when sorting smaller sized fungible product. However, when sorting larger fungible products such as tomatoes or potatoes, mechanical ejector mechanisms are almost universally used. That is, when the substandard product arrives opposite the ejector, the ejector is moved into physical contact with the substandard product forcing it out of the standard product stream. A typical ejector includes an ejector finger which is forced into the product stream to remove detected substandard products by an actuating means, such as that shown in U.S. Pat. No. 4,260,062 issued to Lockett and assigned to the assignee of the present invention. The ejector finger is actuated by a pneumatic valve having a pneumatic cylinder rigidly mounted to a stationary frame, wherein the finger is pivotally connected to the frame, a connection stationary relative to the product stream and pivotally connected to the rod of the cylinder, and a connection movable relative to the product stream. Upon receipt from the electrical actuating signal from the sensor, the valve is activated, thereby extending the cylinder rod and extending the finger into the product stream. This is done with such speed and accuracy that substandard products can be removed from the product stream, while standard products are allowed to continue undisturbed in the "good" product stream. The ejection cycle can occur in excess of 1/30th a second.

An ejector finger of the type described above includes an elongate contactor pivotally connected to the frame by a pin and bushing. The contactor is also pivotally connected to the cylinder rod by a second pin and bushing. Although this type of ejector finger is presently being used to sort products effectively, the life span of a finger is short relative to the life span expectancy of a sorting machine. This short life span is due to the wear on the pivot points. The wear is primarily caused by a combination of environmental effects, including, mud, dust, dirt and small bits of product, the speed of an ejection cycle, and the number of ejection cycles the finger undergoes during the lifetime of the machine. Typically, an ejector finger may be cycled as many times as three (3) million cycles in a three month period, which represent the approximate time of a harvesting season. In most cases, the ejector finger will not last the duration of a harvesting season and require replacement. Most of the industrial sorters include a plurality of fingers associated with each of a plurality of sensors. Replacing these fingers prior to the end of a harvesting season is a very costly and time consuming process, not to mention, an inconvenience during the most active time of the machine's use.

Another problem associated with the ejector described above is due to the mechanism mounting the ejector to the sorting machine frame. Typically the tail end of the pneumatic cylinder is supplied with a mounting plate for connecting to a clevis and pin. The clevis is then rigidly bolted or rivetted to the frame of the sorting machine. This rigid mounting mechanism undergoes significant amount of stress during a harvest season and many times requires replacement. The clevis pin arrangement is typically very expensive.

In an attempt to design an ejector that will last the duration of a harvest season without requiring replacement, the assignee of the present invention developed a new ejector finger described in U.S. Pat. No. 5,279,426. The ejector finger described in this patent is of a monolithic structure and of homogeneous material. Thus, the pins and bushing of the ejector finger mentioned above and thus, the wear points, have been replaced by hinges of reduced dimensions eliminating the wear due to the combination of environmental effects, including mud, dust, dirt, and small bits of product. Even though the life span of this new finger is longer than that of the ejector finger described above, some fingers still do not last the duration of the harvest season.

Therefore, it is a feature of the present invention to provide an improved sorting machine including a mechanical ejecting separation of substandard products, from a stream of products wherein the mechanical ejector mechanism will function at least through the duration of a harvest season.

It is another feature of the present invention to provide an improved mechanical ejector for separating substandard products from a stream of products passing through a sorting machine, wherein the mechanical ejector is less susceptible to the environmental conditions than prior art ejectors to thereby enhance the life span of the ejector.

It is yet another feature of the present invention to provide an improved less expensive and easily replaceable mechanical ejector for separating substandard products from a stream of products passing through a sorting machine.

SUMMARY OF THE INVENTION

In accordance with the present invention, a sorting machine for separating identifiable substandard products and other items from a stream of products traveling through the machine includes a viewing means having at least one optical sensor element positioned for viewing a viewing area through which the products pass. An electronic means is connected to the sensor element for producing an actuator signal whenever a substandard item in the product stream is detected by the sensor element. An ejector located downstream from the viewing means is actuated by the actuator signal to eject each detected substandard item. The ejector includes an ejector finger and an actuator for moving the ejector finger to eject each detected substandard item from the product stream. The ejector finger consists of a flexible elongate base member having one end fixedly attached with respect to the product stream and a rigid contactor normally withdrawn from the product stream when standard products are in the stream and for entering the product stream to eject a detected substandard item, such contactor being connected intermediate the ends of the base member. An actuator connected to the other end of the base member is movably operated upon the receipt of the actuator signal for flexing the base member to move the ejector contactor so that it enters the product stream to eject each detected substandard item therefrom. The actuator is also attached to the frame at the front end of the cylinder rather than the back.

In an alternate embodiment of this invention, the ejector utilizes an ejector finger that include a flexible member fixedly attached at one end with respect to the product stream and a rigid member attached to the other end of the flexible member creating a contactor. The contactor is connected to an actuator, which is movably operated upon receipt of an actuator signal for flexing the ejector for removal of the ejectable products from the product stream.

Also disclosed is a sorting machine ejector mounting mechanism for mounting an ejector that includes an ejector finger pivotally connected to the sorting machine and an actuator to a sorting machine frame. A flexible elongate member is bolted on one end to a mounting plate permanently affixed to the tail end of the actuator and on the other end to said mounting bracket permanently affixed to the frame.

Thus, all pins and bushing at the pivot points employed with the prior art finger ejectors described above are not present in either of the embodiments described herein, making the ejector finger less susceptible to wear due to the environmental conditions and longer lasting. Also, the number of parts has been significantly reduced from the ejector fingers described above, thus, reducing the cost of the ejector.

BRIEF DESCRIPTION OF THE DRAWINGS

So that the manner in which the above recited features, advantages and objects of the invention as well as others which will become apparent, are obtained and can be understood in detail, more particular description of the invention briefly summarized above may be had by reference to the embodiment thereof which is illustrated in the appended drawings, which drawings form part of this specification. It is to be noted, however, that the drawings illustrate only a preferred embodiment of the invention and is therefore not considered limiting of scope as the invention may admit to other equally effective embodiments.

In the Drawings:

FIG. 3*a* is an elevational view of a prior art ejecting mechanism in the retracted position.

FIG. 3*b* is an elevational view of the ejector mechanism shown in FIG. 3*a* in the ejecting position.

FIG. 4*a* is elevational view of another prior art ejecting mechanism in the retracted position.

FIG. 4*b* is the elevational view of another prior art ejecting mechanism of FIG. 4*a* in the ejecting position.

DESCRIPTION OF THE PREFERRED EMBODIMENT

Figure 1:
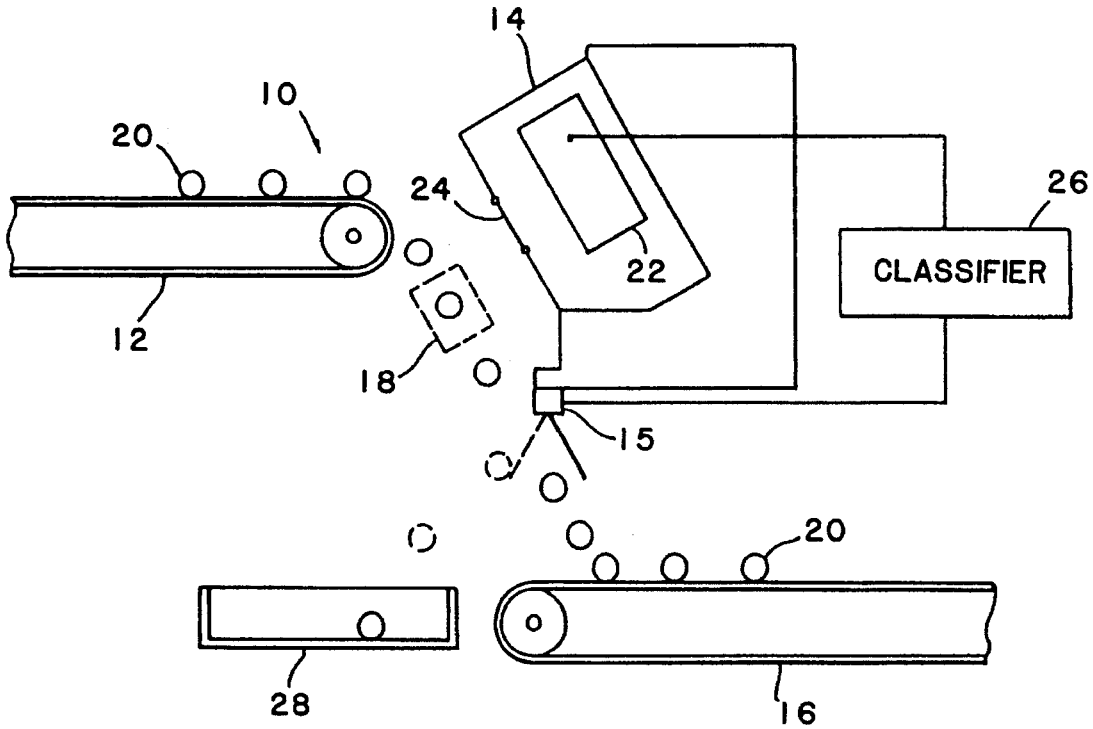
FIG. 1 is an elevational view of sorting machine for separating substandard products from a stream of fungible products in accordance with the preferred embodiment of this invention.
Figure 2:
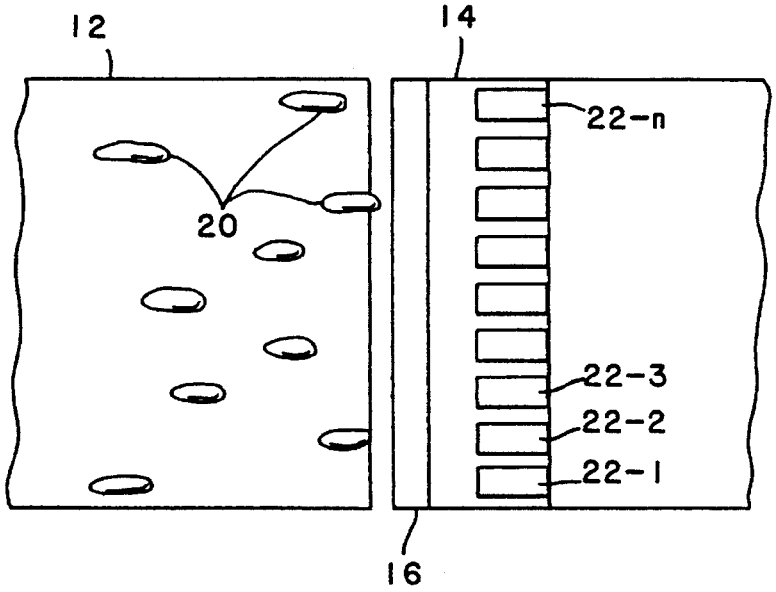
FIG. 2 is a plan view of the machine shown in FIG. 1.

Now referring to the drawings, and first to FIGS. 1 and 2, a multi-detector, high speed sorter for separating substandard fungible products from a passing stream of such products is shown. Generally, machine 10 includes incoming conveyor belt 12, viewing means 14, ejector 15, and lower conveyor belt 16. Incoming conveyor belt 12 is located above viewing area, which is diagrammatically indicated as 18, such that when product 20 drops off the end of incoming conveyor belt 12, gravity pulls product 20 through viewing area 18. Lower conveyor belt 16 is located beneath viewing area 18 such that any standard product lands on lower conveyor belt 16 after passing viewing area 18.

The products to be separated or sorted by machine 10 are normally comestible products such as tomatoes that are graded and separated on the basis of color characteristics. Of course, any products, comestible or other, that are separable on the basis of color distinction can be sorted.

Viewing means 14 may include a plurality of sensor elements or detectors, indicated by reference numeral 22-1, 22-2, 22-3, . . . 22-n. The 22-1 . . . 22-n sensor elements are disposed in a side by side arrangement so as to completely encompass within their field of view the illuminated viewing area 18. Optical sensors 22 are located within viewer 14 behind window 24 to prevent sensors 22 from being damaged or contaminated by dirt unavoidably encountered during the sorting process. As the flow of product passes by sensors 22, substandard items are sensed or detected. The sensing can be in a single spectral range for monochromatic detection, into separate spectral ranges for bi-chromatic detection, or in a plurality of spectral ranges from multi-chromatic detection. It is understood that a "spectral range" can be wholly or partially in the visual spectrum or can be wholly or partially in the non-visual spectrum. For example, sensing in the infrared range is commonly done. There are many optical sensor schemes well-known in the art.

When a substandard item is sensed, sensor 22 produces an electrical signal reflective of the color being detected. Classifier 26 receives the electrical signal and produces an actuating signal in the event the detected item is substandard. The actuation signal will activate ejector 15 when the substandard item and ejector 15 are in alignment. The sensor and classifier used in the preferred embodiment of the invention are fully described in U.S. Pat. No. 5,278,768, commonly assigned, which is incorporated herein for all purposes.

The delay in actuation is very short following the time of sensing, the timing being such to produce the desired expelling of the detected substandard item and is accomplished in a manner well known in the art. The items removed in the process fall down into reject accumulator 28 for subsequent disposal. The items not removed from the product stream continue to fall onto lower conveyor belt 16 to be gathered or packaged as quality products passing the preset sorting standard. The control of the flow and the sensitivity of the sensors are controlled by preset controls that are well known in the art.

The sorting machine, having the characteristics described above, used in the preferred embodiment of the invention, is the COLORWATCH system, Model Number 49033, manufactured and distributed by the assignee of the present invention, which is an electronically controlled optical sorting machine. The basic principles of operation are typical of other electronically controlled optical sorters. A product is brought into the machine, tested for distinguishing characteristics, and accepted or rejected based on those characteristics. However, this machine is specially designed to discriminate between acceptable and unacceptable products by optically detecting the color of each product and comparing it to minimum acceptable standards.

Once a substandard item is detected, an ejector such as that shown in FIGS. 3*a* and 3*b* is activated to physically remove the substandard item from the stream as shown in FIG. 3*b*. Normally the ejector is in the retracted position to allow acceptable products to flow down to lower conveyor belt 16 as shown in FIG. 3*a*. The ejector includes the cylinder of a pneumatic valve (not shown) attached to mounting platform 50, and finger, generally referred to as 52. Finger 52 is mounted to mounting platform 50 through mounting bolt 54. Piston 56 of the pneumatic cylinder is pivotally connected to finger 52 by a pin and bushing at pivot point 58. As finger 52 is extended by piston 56, finger 52 pivots around pivot point 60 which includes a pin and bushing. It is the pins and bushings located at pivot points 58 and 60 that often break down due to wear caused by environmental conditions prior to the end of a single sorting season.

FIGS. 4*a* and 4*b* show another prior ejector finger 70 in the retracted and ejecting positions, respectively. Ejector finger 70 is a monolithic structure comprised of a homogeneous material. Even though the pins and bushing of the ejector finger shown in FIGS. 3*a* and 3*b* are not present, failures still occur at hinge point 72 and 74.

Both of the prior art ejectors are mounted to the mounting platform 50 in the same manner. Clevis 62 which is rigidly mounted to the mounting platform is attached to cylinder mounting plate 64 by pin 66. This rigid mounting scheme undergoes a significant amount of stress during a harvest season and sometimes becomes damaged due to the stress.

FIGS. 5*a* through 5*d* show ejector finger 80 constructed in accordance with the preferred embodiment of this invention in both the retracted and ejecting positions. Ejector 80 is comprised of a finger and actuator, generally referred to as 82 and 84, respectively.

Ejector finger 82 is comprised of flexible elongate base member 86 and contactor 88. In the preferred embodiment of this invention, base member 86 is made from five (5) ply, food grade, white Nitrile belting, manufactured by Scandura Inc. of Charlotte, N.C., and is 3/16 inches ("in.") thick. Contactor 88 is a ¾ in. wide aluminum strip that is 3/16 in. thick. Contactor 88 is four inches long up to curved section 90 of the contactor, which is 0.74 in. long over a 45° radius. Contactor is rivetted to base member 86 by four ⅛ in. rivets. The four rivets are placed ⅜ of an inch apart across the width of contactor 88 and 30° apart along curved section 90.

Actuator ejector 80 includes a pneumatic valve (not shown) connected to cylinder 51 having piston 56 therein. Any cylinder piston arrangement well known to those of ordinary skill can be used in this application. Only slight modifications are necessary to connect the arrangement to the mounting platform and finger. For example, elbow bracket 100 must be attached to the front end of cylinder 51, as shown. The elbow bracket 100 is in turn secured to a mounting platform of the sorting machine, at which time the cylinder arrangement is mounted stationarily relative to the product stream.

Figure 5B:
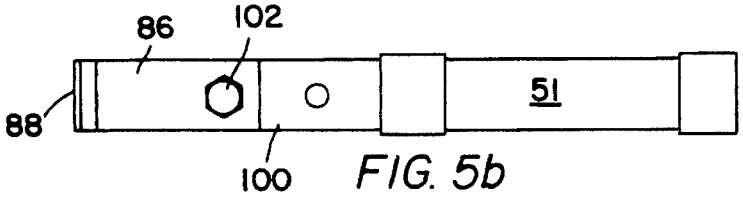
FIG. 5*b* is a plan view of the ejector shown in FIG. 5*a*.
Figure 5E:
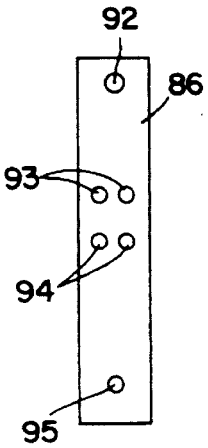
FIG. 5*e* is a plan view of an ejector finger base member constructed in accordance with the preferred embodiment of this invention.
Figure 5A:
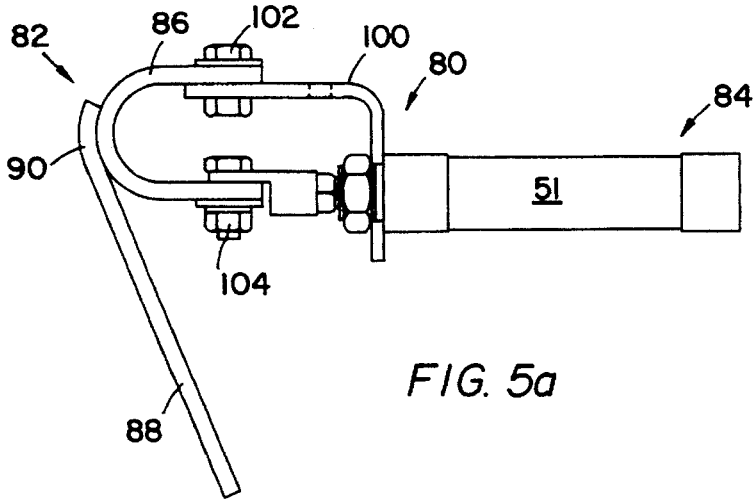
FIG. 5*a* is an elevational view of an ejector constructed in accordance with the preferred embodiment of this invention in the retracted position.
Figure 5D:
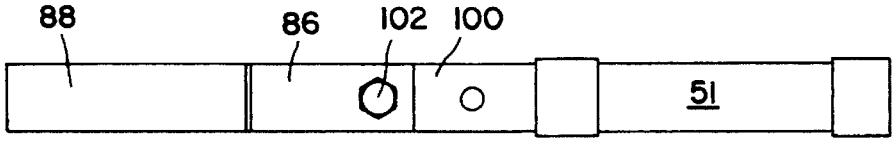
FIG. 5*d* is a plan view of the ejector shown in FIG. 5*c*.
Figure 5C:
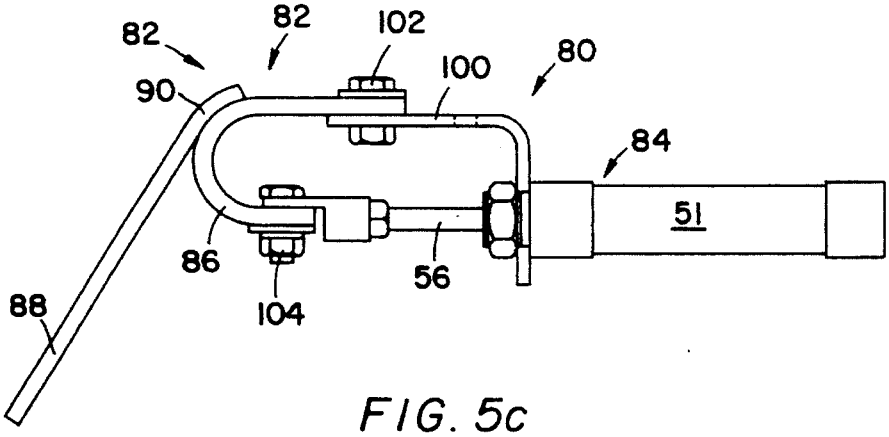
FIG. 5*c* is an elevational view of an ejector constructed in accordance with the preferred embodiment of this invention in the ejecting position.

FIG. 5*e* shows base member 86 prior to assembly, which when in a flat position is 4 3/16 in. long. Measuring from the top end of the base member, bolt hole 92 for attaching the base member to the elbow bracket 100 is located at ⅜ in., rivet holes 93 are located at 2 in., rivet holes 94 are at 2⅜ in., and bolt holes 95 for attaching the base member to piston 56 is located at 3 3/16 in.

Finger 82 is mounted to the actuator 84 through by base member 86; one end is mounted to elbow member 100 by bolt 102 and the other end of base member 86 is mounted to piston 98 by bolt 104. The length of base member 86 and the mounting position of contactor 88 thereon are dependent upon the stroke distance of piston 56. It is critical that base member be moved in such a way as to maintain a constant arc at the connection between the contactor and the flexible member. Otherwise, the rivets connecting the two pieces will be dislodged. For a radius of 0.54 in., the contactor can travel through a range of 54°.

Even though base member 86 is made of food grade belting, any material can be used which is capable of being used in the particular sorting environment and strong enough to withstand the requisite number of cycles. Also, the size and dimension may be varied without any critical concerns, except for maintaining the curved part of the contactor on a constant arc through the entire range of motion of the contactor.

The size, shape, and material of the contactor is also not critical. Selection is based on the type of products being sorted. For example, the contactor can be tapered or nub-like instead of elongated.

Thus, the wear from pivot points and the rigid mounting clevis/pin arrangement of the prior art ejectors have been removed, reducing the total number of parts and, thus, the cost of the ejector. The ejector is also much less susceptible to wear due to the fact that no more pivot points exist.

Figure 6:
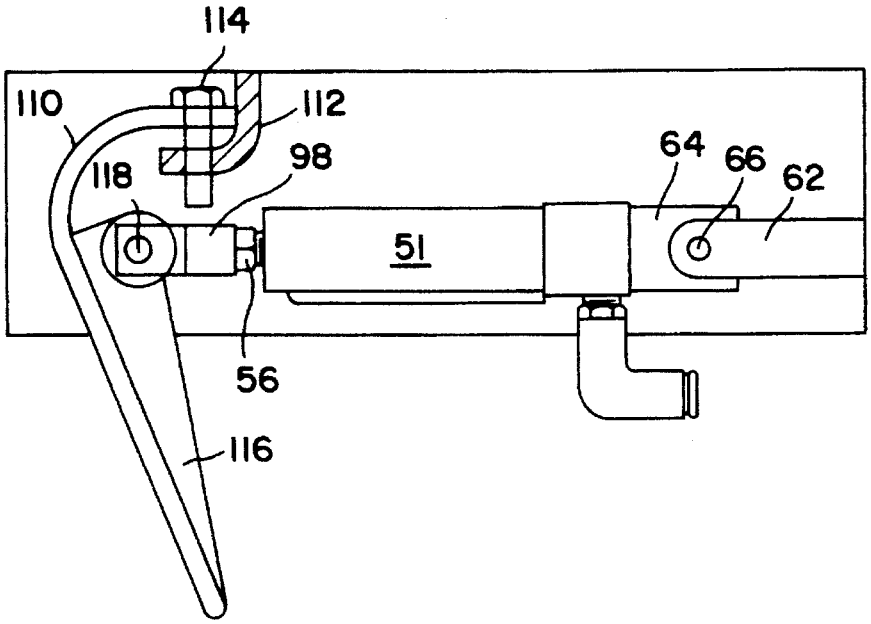
FIG. 6 is an elevational view of an ejector constructed in accordance with an alternate embodiment of this invention.

FIG. 6 shows an alternate embodiment of the present invention, wherein the tail end of cylinder 51 is rigidly mounted to a mounting platform by clevis 62, mounting pin 66, and cylinder mounting plate 64. Flexible elongate base member 110 is stationarily mounted relative to the product stream at mounting platform frame 112 by bolt 114. The other end of flexible member 110 is affixed to rigid structure 116 which can be made of nylon, plastic, or any other material rigid enough to eject products. Affixation of base member to the rigid support structure can be effected by adhesives or rivets. Piston end 98 of piston 56 is pivotally mounted to rigid support structure 116 by pin and bushing 118. Even though a pivot point remains in this design, the replacement of the other pivot point with the flexible elongate member significantly increase the longevity of the finger.

Figure 7:
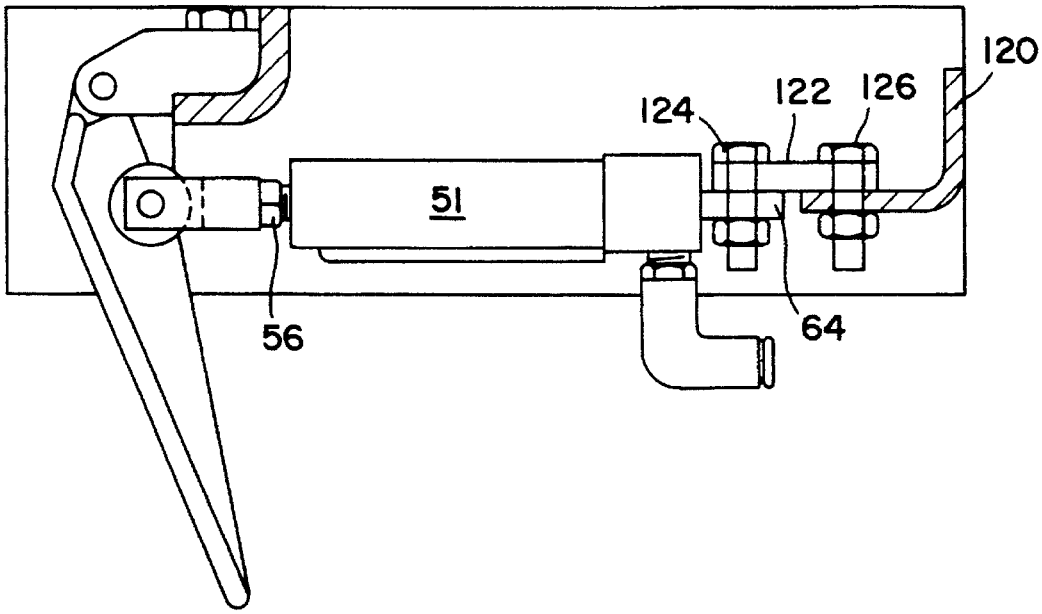
FIG. 7 is an elevational view of an ejector mounting mechanism constructed in accordance with the preferred embodiment of this invention.

FIG. 7 shows a flexible belt clevis mounting mechanism made in accordance with the present invention. Mounting plate 64 is rotated 90° from the position shown in FIG. 6. An elbow 120 is rigidly mounted to the mounting platform. Flexible elongate mounting member 122, which in the preferred embodiment of this invention is ⅜ in. thick, two (2) ply, 3/16 in.×1/16 in. RMA belting, manufactured by Scandura Inc. of Charlotte, N.C., is connected to mounting plate 64 and elbow 120 by bolts 124 and 126. This particular mounting device can be used with the prior art dual-pivot point finger such as that shown in FIG. 7 or with the finger shown in FIG. 6.

It is also apparent that the products could be passed by the viewing window by some other means other than the conveyor belt, the invention not being limited by the manner by which the product stream is achieved. Moreover, the particular viewing arrangement of sensors and the electronic system creating the actuation signal to the actuator is not critical to the invention, although a particular mode of operation well known in the art has been described for each thing. Moreover, the ejector finger is not limited to an inspection sorting application. For example, it may be used in a manufacturing application to move a part from an assembly line during the manufacturing procedure. Thus, it would be understood that while a preferred embodiment and alternate embodiment of the invention have been shown and described, the invention is not limited hereto. Many modifications may be and will become apparent to those skilled in the art.

What is claimed is:

1. An ejector for an electronic sorting machine having a detector for the detection of the presence of ejectable products in a product stream and generating an actuator signal in response to the detection of an ejectable product, said ejector for removing the ejectable products from the product stream in response to the receipt of the actuator signal, comprising an ejector finger including a flexible elongate base member having a first end and a second end, said first end fixedly attached with respect to the product stream, and a contactor made of a material rigid enough to remove the ejectable products from the product stream when brought into ejector contact therewith, said contactor being connected intermediate the ends of said base member; and an actuator connected to said second end of said base member movably operated upon the receipt of the actuator signal for flexing said base member to move said contactor for removal of the ejectable products from the product stream.

2. An ejector in accordance with claim 1, wherein said base member is U-shaped.

3. An ejector in accordance with claim 2, wherein said contactor is elongated.

4. An ejector in accordance with claim 3, wherein said contractor is elongated having a first end and a second end, said first end of said actuator being connected to said base member.

5. An ejector in accordance with claim 4, wherein said second end of said elongated contactor is tapered.

6. An ejector in accordance with claim 1, wherein said base member is a belting material.

7. An ejector in accordance with claim 1, wherein said contactor is aluminum material.

8. An ejector for an electronic sorting machine having a detector for the detection of the presence of ejectable products in a product stream and generating an actuator signal in response to the detection of an ejectable product, said ejector for removing the ejectable products from the product stream in response to the actuator signal, comprising an ejector finger, including a flexible member for being fixedly attached at one end to the sorting machine with respect to the product stream, and a rigid member attached to the other end of the flexible member, thereby creating a contactor, said contactor normally being withdrawn from the product stream for the removal of ejectable products from the product stream when brought into ejector contact therewith; and an actuator connected to said contactor movably operated upon receipt of the actuator signal for flexing said ejector finger for removal of the ejectable products from the product stream.

9. An ejector in accordance with claim 8, wherein said actuator includes a piston and a cylinder, additionally comprising an ejector mounting mechanism, comprising a mounting plate permanently affixed to the cylinder of said actuator for affixing said cylinder to a frame portion of the sorting machine, a mounting bracket permanently affixed to a frame portion of the sorting machine; and a flexible elongate member having a first end and a second end, said first end being bolted to said mounting bracket and said second end being connectable to said actuator piston.

10. An ejector in accordance with claim 8, wherein the rigid member is a hard plastic glued to the side of the flexible member opposite the side of the flexible member that enters the product stream to remove the ejectable products.

11. A sorting machine ejector mounting mechanism for mounting an ejector to a sorting machine frame, the ejector including an ejector finger pivotally connected to the sorting machine and an elongate actuator having a first end and a second end, the mounting mechanism, comprising a mounting plate permanently affixed to the first end of the actuator for mounting the actuator to the sorting machine frame, a mounting bracket permanently affixed to the frame, and a flexible elongate mounting member connectable on its first end to the second end of the actuator and on its second end to said mounting bracket.

12. A sorting machine ejector mounting mechanism in accordance with claim 11, wherein said flexible elongate member is a belting material.

* * * * *